United States Patent [19]

Sakuma

[11] 4,074,271

[45] Feb. 14, 1978

[54] ADJUSTABLE ANTENNA HOLDING DEVICE

[75] Inventor: Kotoku Sakuma, Toride, Japan

[73] Assignee: American Electronics, Inc., Greenwood, Ind.

[21] Appl. No.: 708,261

[22] Filed: July 23, 1976

[30] Foreign Application Priority Data

Jan. 31, 1976 Japan ..... 51-10490[U]

[51] Int. Cl.[2] ..... H01Q 1/08

[52] U.S. Cl. ..... 343/882; 343/715; 403/322

[58] Field of Search ..... 343/709, 711, 712, 713, 343/715, 878, 881, 882; 403/322, 93, 96, 325, 327, 328

[56] References Cited

U.S. PATENT DOCUMENTS

| | | | |
|---|---|---|---|
| 610,469 | 9/1898 | Blashfield | 403/96 |
| 2,501,581 | 3/1950 | Rieger | 403/96 |
| 3,191,898 | 6/1965 | McCullough | 343/888 |
| 3,433,510 | 3/1969 | Hulterstrum | 403/93 |

FOREIGN PATENT DOCUMENTS

| | | | |
|---|---|---|---|
| 853,839 | 11/1960 | United Kingdom | 343/882 |

*Primary Examiner*—Eli Lieberman

*Attorney, Agent, or Firm*—Woodard, Weikart, Emhardt & Naughton

[57] ABSTRACT

An antenna holding device is disclosed herein which comprises a first member defining a recess and a second member including a projection extending within the recess. A pivot pin hingedly connects the projection of the second member within the recess of the first member. A plurality of concavities are formed along the projection of the second member in an arc having the pivot pin as the center. The first member includes a cylindrical channel which extends radially from the pivot pin and communicates with the recess. A second channel in the first member extends perpendicular to and communicates with the first channel. A spherical ball is received within the first channel and may be moved to extend into the recess sufficiently to engage one of the concavities defined by the projection of the second member. A spring-biased, push button is received within the second channel and includes a concavity which may be positioned adjacent the first channel. When so positioned, the spherical ball within the first channel may be moved into the concavity of the push button to disengage the concavity defined by the projection of the second member, thereby permitting rotation of the second member with respect to the first member. Releasing the push button causes the concavity therein to move out of communication with the first channel, thereby forcing the spherical ball along the first channel and into engagement with one of the concavities of the projection of the second member.

22 Claims, 5 Drawing Figures

ADJUSTABLE ANTENNA HOLDING DEVICE

BACKGROUND OF THE INVENTION

1. Field of the Invention

The present invention relates to the field of antenna holding devices, and in particular, to the field of devices for securely retaining an antenna in a variety of positions.

2. Description of the Prior Art

A variety of mechanisms for holding various items in different selected positions are known in the prior art. In U.S. Pat. No. 1,783,630, issued to Shaeffer et al. on Dec. 2, 1930, there is disclosed a fountain pen desk stand which includes a mechanism for positioning the stand in a number of selected positions. The Shaeffer device includes a base and a pen holder hingedly attached thereto. The bottom of the pen holder defines a series of depressions arranged arcuately about the pin which connects the holder to the base. Located within the base is a compressed coil spring supporting a plunger having an upper surface shaped complementary with the depressions of the pen holder, and positioned to engage a selected depression. To change the position of the pen holder relative the base, the holder is simply rotated about the pivot pin and the force behind this rotation displaces the plunger from the depression and the holder is moved until the plunger seats within one of the other depressions. A nearly identical arrangement is disclosed in U.S. Pat. No. 1,318,148, issued to Herwig on Oct. 7, 1919. Although these devices are suitable for many purposes, such as those described in the selected patents, they are not suitable for use with an antenna which may be subjected to considerable external forces even when it is not desired that the position of the antenna change. Structures such as those disclosed in the Shaeffer et al. and Herwig patents do not provide sufficient resistance to rotation of the supported member to be useful in conjunction with antennas which may, for example, be mounted upon the exterior of a vehicle.

A second type of adjustable hinge connection is disclosed in U.S. Pat. No. 165,236, issued to Jenness on July 6, 1875. The Jenness patent discloses a construction for brushes which includes a handle pivotally mounted to the brush. The brush includes an arcuate surface extending parallel to the brush handle, and which is normal to the axis of rotation of the handle. A plurality of notches are spaced along the arcuate surface and a spring-biased lock bolt is connected to the handle to engage a selected notch. To change positions of the brush handle, the lock bolt is manually retracted from the notch and the handle is then rotated to a desired position, the lock bolt then being allowed to extend into the then appropriate notch. A substantially identical mechanism is disclosed in U.S. Pat. No. 132,494, issued to Ripley on Oct. 22, 1872, in conjunction with a design for an adjustable desk top. These devices are also well suited to particular application, but entail certain disadvantages for use in conjunction with antennas which would be mounted upon vehicles or other outdoor structures. Primarily, the fact that the Jenness and Ripley devices include exposed locking structures makes them disadvantageous for outdoor antennas since these locking structures would be susceptible to fouling, particularly due to weather conditions, and also to other types of damage.

In U.S. Pat. No. 2,706,608, issued to Joseph on Apr. 19, 1955, there is disclosed an antenna mounting device which enables the antenna to be supported either parallel or perpendicular to the base. A similar antenna mount is disclosed in U.S. Pat. No. 3,886,560, issued to Mortensen et al. on May 27, 1975. Neither of these devices, however, provide a means for retaining the antenna in other than two positions.

SUMMARY OF THE INVENTION

An antenna holding device which comprises a first member, a second member hingedly attached to the first member to pivot about a rotational axis, the first member including a plurality of concavities formed on an arc of a circle having the rotational axis extending normal to the center thereof, the second member including a first channel opening adjacent one of the concavities of the first member, and a second channel communicating with and extending other than parallel to the first channel and a locking assembly including a locking member received within the first channel of the second member and movable therethrough to extend within one of the concavities of the first member, and further including a release member received within the second channel of the second member and abutting the locking member, the locking assembly having a locking condition in which the release member is in a first position and the locking member projects into one of the concavities of the first member, and a release condition in which the release member is in a second position and the locking member is withdrawn from the concavity of the first member to permit rotation of the second member relative the first member about the rotational axis.

It is an object of the present invention to provide an antenna holding device which permits the antenna to be secured in a variety of selected positions.

Another object of the present invention is to provide an antenna holding device which enables the antenna to be positioned vertically, despite the orientation of the surface upon which the antenna is mounted.

A further object of the present invention is to provide an antenna holding device which fulfills the above requirements and which further does not include any exposed, moving parts.

It is another object of the present invention to provide an antenna holding device which may be simply and inexpensively constructed.

A further object of the present invention is to provide an antenna holding device which may be readily adjusted to vary the position of the antenna, and which also securely holds the antenna in the selected position.

Further objects and advantages of the present invention will become apparent from the figures and description which follow.

DESCRIPTION OF THE PREFERRED EMBODIMENTS

Figure 1:
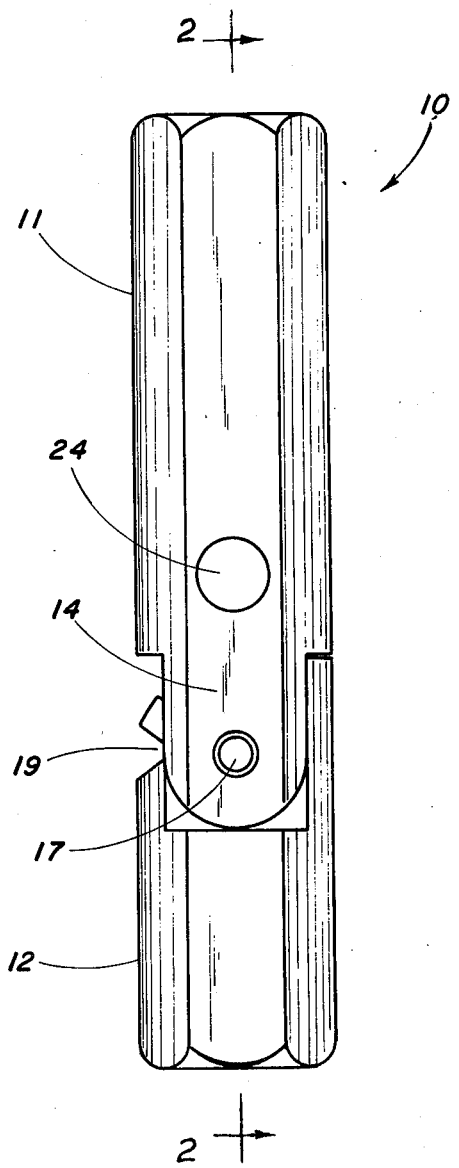
FIG. 1 is a right side plan view of an embodiment of the antenna holding device of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

For many types of antennas, the positioning of the antenna will effect the efficiency with which signals are recieved or transmitted. A bar-shaped antenna, for example, has the best reception sensitivity generally when it is positioned perpendicular to the ground. In mounting such an antenna on an automobile, however, there is only a limited area of horizontal surface, and there is therefore a limitation on the placement of the antenna. This problem is overcome by the present invention, however, by providing an antenna holding device which is capable of supporting the antenna in a generally-perpendicular orientation despite the positioning of the surface to which it is attached.

It is also necessary that an antenna which is attached, for example, to an automobile, must be moved to avoid contact with a garage ceiling, or similar structure. One manner of compensating for this problem is to provide the antenna with sufficient flexibility that the tip may be pulled downwardly with a string or wire to decrease the height to which the antenna extends. This requires, however, that the antenna be both flexible (which may not be desirable), and that the troublesome procedure of pulling the tip of the antenna down be repeated frequently. The antenna holding device of the present invention, however, is capable of supporting the antenna in a perpendicular orientation while also permitting the antenna to be readily adjusted to other positions as desired.

Figure 2:
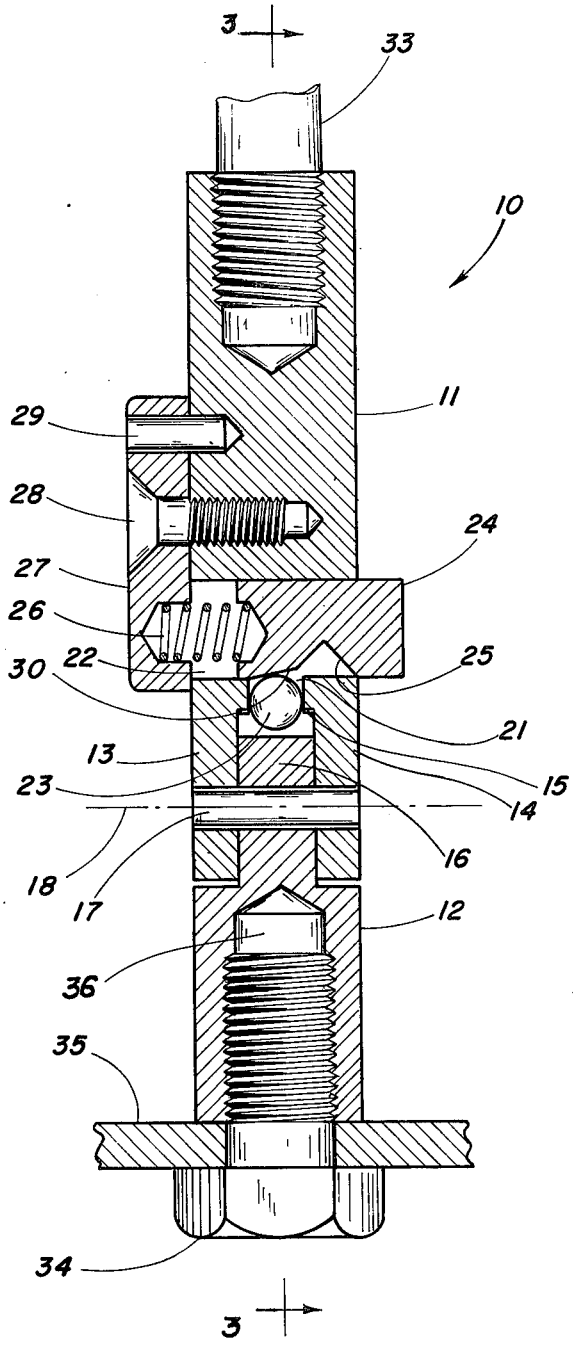
FIG. 2 is a front, cross-sectional view of the antenna holding device taken along the line 2—2 in FIG. 1, and indicating the manner of attachment of the device to a surface.

Referring now to the figures, there is shown an antenna holding device 10 according to the present invention. Device 10 includes bar-shaped members 11 and 12 shown with a hexagonal shape, although this is not required. Member 11 includes legs 13 and 14 which define an recess 15 (FIG. 2). Member 12 includes projection 16 (FIG. 2) which is received within recess 15. Pivot pin 17 extends through an aperture defined by projection 16 and is connected to legs 13 and 14, thereby providing a hinged attachment of members 11 and 12. Relative rotation of members 11 and 12 occurs about rotational axis 18 (FIG. 2).

Figure 3:
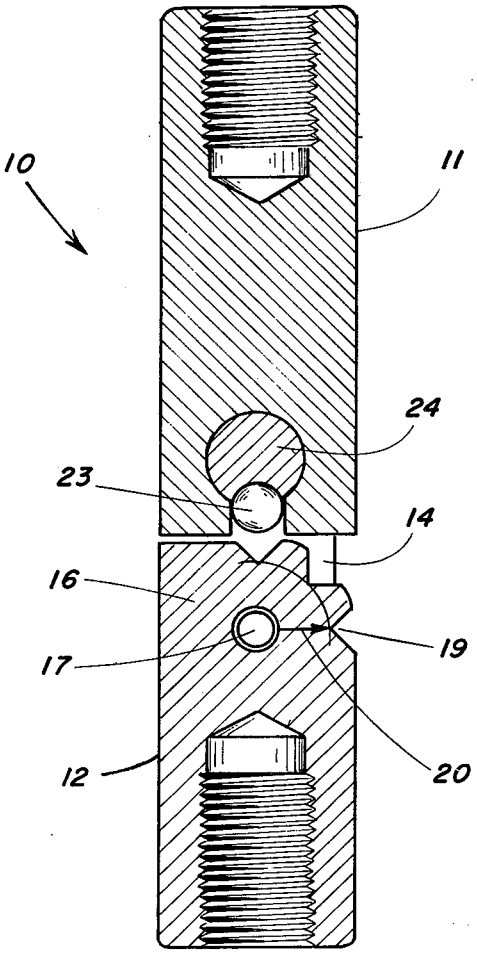
FIG. 3 is a left side view of the antenna holding device of the present invention, taken along the line 3—3 in FIG. 2.

Projection 16 of member 12 includes a plurality of concavities 19 which are formed on an arc 20 (FIG. 3) of a circle having pivot pin 17 extending normal to the center of the circle.

Member 11 includes a cylindrical channel 21 which extends radially from rotational axis 18, and which communicates with recess 15. A second cylindrical channel 22 is defined by member 11, and extends perpendicular to and communicates with channel 21. A spherical, steel ball 23 resides in channel 21 and is sized to permit movement along channel 21. A push button shaft 24 is received within channel 22, and retains ball 23 within channel 21. Shaft 24 includes a concavity 25 which is positioned to communicate directly with channel 21 when shaft 24 is fully pushed within channel 22. In this position, ball 23 is free to move upwardly in FIG. 2 and partially into concavity 25. This constitutes a release condition (FIG. 3), in which there is no resistance to relative rotation of members 11 and 12. The direction of movement of shaft 24 is parallel to rotational axis 18 as shown in FIGS. 1 and 2.

Shaft 24 is spring-biased away from the release condition by a spring 26 located within channel 22. Spring 26 is maintained in position by retaining plate 27, which is secured to member 11 by bolt 28 and pin 29 (FIG. 2). The action of spring 26 urges shaft 24 into the locking condition (FIG. 2), in which concavity 25 is moved away from communication with channel 21. Ball 23 is thereby forced downwardly in FIG. 2 along channel 21 and seats within one of the concavities 19 of second member 12. Ball 23 engages the surfaces defining the concavity 19 in which it is received, and thereby prevents relative rotation between member 11 and 12. Shaft 24 further includes a tapered surface 30 (FIG. 2) which engages ball 23 in the locking condition, and which also prevents shaft 24 from being fully removed from channel 22.

Device 10 includes screw holes 31 and 32 at the non-hinged ends of members 11 and 12, respectively. A bar-shaped antenna 33 (FIG. 2) is received within screw hole 31. Screw portion 36 of bolt 34 (FIG. 2) is received within screw hole 32, and secures device 10 to a surface 35, such as a portion of an automobile.

Figure 4:
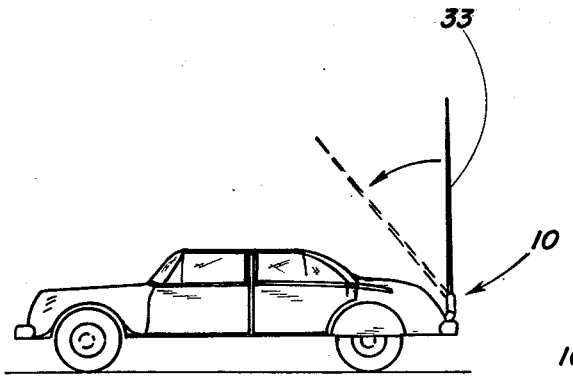
FIG. 4 is a side view of the antenna holding device of the present invention, shown mounted upon an automobile.

Referring in particular to FIG. 4, it is shown that the antenna holding device of the present invention makes it possible to erect an antenna 33 in a vertical position by proper adjustment of the antenna holding device 10. This is possible even though the location at which the antenna holding device is installed may be an inclined surface. In addition, it is possible to simply change the bending angle of the antenna holding device 10 by pressing the push button shaft 24. As a result, the orientation of antenna 33 is easily moved to the position shown by the dotted line in FIG. 4, thereby preventing the antenna from contacting a garage ceiling or similar structure.

Figure 5:
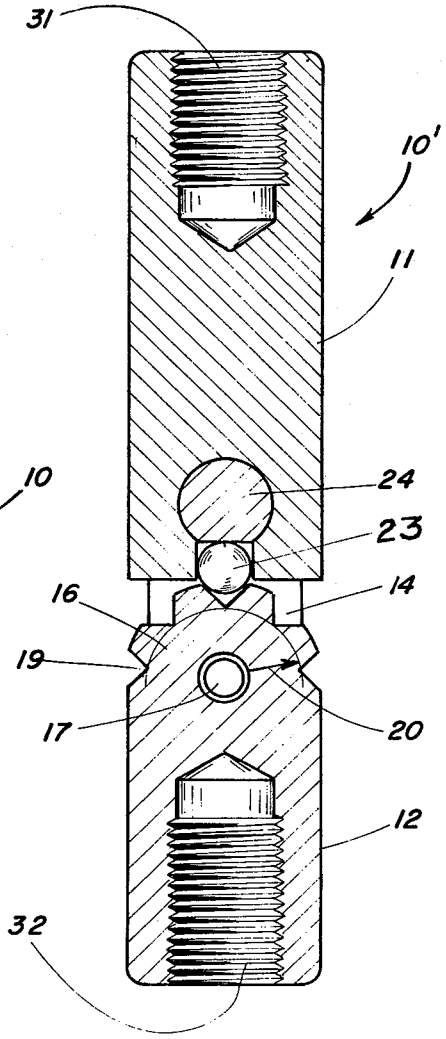
FIG. 5 is a side, cross-sectional view of another embodiment of the antenna holding device of the present invention.

In FIG. 5 there is shown an alternate embodiment of the antenna holding device 10 of the present invention. The antenna holding device 10' includes concavities 19 which lie along a full half circle, thereby permitting the orientation of member 11 to be rotated relative member 12 along a full 180°. Other modifications of the structural elements of the antenna holding device of the present invention could similarly be made to suit specific requirements. For example, decreasing the size of channel 21 and steel ball 23, along with the size of the concavities 19, would permit the antenna holding device to provide a greater number of locking positions.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. An antenna holding device which comprises:

a first member;

a second member hingedly attached to said first member to pivot about a rotational axis, said first member including a plurality of concavities formed on an arc of a circle having the rotational axis extending normal to the center therof, said second member including a first channel opening adjacent one of the concavities of said first member, and a second channel communicating with and extending other than parallel to the first channel;

a locking assembly including a locking member received within the first channel of said second member and movable therethrough to extend within one of the concavities of said first member, and further including a release member received within the second channel of said second member and abutting the locking member, said locking assembly having a locking condition in which the release member is in a first position and the locking member projects into one of the concavities of said first member, and a release condition in which the release member is in a second position and the locking member is withdrawn from the concavity of said first member to permit rotation of said second member relative said first member about the rotation axis;

said release member being movable in a direction between said first position and said second position; and said direction being substantially parallel to said rotational axis.

2. The device of claim 1 in which said second member includes spring biasing means for urging the release member from the second position to the first position.

3. The device of claim 2 in which said spring biasing means comprises a coiled spring located within the second channel of said second member.

4. The device of claim 2 in which the release member extends exterior of said second member to permit direct manual operation of the release member.

5. The device of claim 1 in which the concavities of said first member taper outwardly away from the rotational axis, whereby the locking member is forced from a concavity by rotation of said first member relative said second member.

6. The device of claim 1 in which the locking member is a sphere.

7. The device of claim 6 in which the first channel is cylindrical.

8. The device of claim 7 in which the first channel extends radially from the rotational axis.

9. The device of claim 1 in which the first channel extends radially from the rotational axis.

10. The device of claim 9 in which the second channel extends perpendicular to the first channel.

11. The device of claim 10 in which the release member includes a concavity, the release member in the second position having the concavity in communication with the first channel and in the first position having the concavity displaced out of communication with the first channel.

12. The device of claim 11 in which sad second member includes spring biasing means for urging the release member from the second position to the first position.

13. The device of claim 12 in which the locking member is a sphere.

14. The device of claim 13 in which the release member extends exterior of said second member to permit direct manual operation of the release member.

15. The device of claim 14 in which the concavities of said first member taper outwardly away from the rotational axis whereby the locking member is forced from a concavity by rotation of said first member relative said second member.

16. The device of claim 1 which includes means for mounting an antenna upon one of said first and second members.

17. An antenna holding device which comprises:

a first member;

a second member including walls defining a recess, said first member including a projection received within the recess of said second member;

a pivot pin, the projection of said first member defining an aperture, said pivot pin extending through the aperture and being connected to opposite walls of the recess, the projection of said first member including a plurality of concavities formed on an arc of a circle having the pivot pin extending normal to the center thereof;

said second member defining a first channel communicating with the recess and a second channel extending other than parallel to the first channel and communicating therewith;

a locking assembly including a locking member received within the first channel of said second member and movable therethrough to extend within one of the concavities of said first member, and further including a release member received within the second channel of said second member and abutting the locking member;

said locking assembly having a locking condition in which the release member is in a first position and the locking member projects into one of the concavities of said first member, and a release condition in which the release member is in a second position and the locking member is withdrawn from the concavity to permit rotation of said second member about the rotational axis;

said release member being movable in a direction between said first position and said second position; and said direction being substantially parallel to said rotational axis.

18. The device of claim 17 in which the first channel extends radially from the rotational axis.

19. The device of claim 18 in which the second channel extends perpendicular to the first channel.

20. The device of claim 17 in which the locking member is a sphere.

21. The device of claim 10 in which the release member includes a concavity, the release member in the second position having the concavity in communication with the first channel and in the first position having the concavity displaced out of communication with the first channel.

22. The device of claim 21 in which said second member includes spring biasing means for urging the release member from the second position to the first position.

* * * * *